US007619577B1

(12) United States Patent
Cheng

(10) Patent No.: US 7,619,577 B1
(45) Date of Patent: Nov. 17, 2009

(54) OPEN-SLOT ANTENNA

(75) Inventor: Yi-Tsan Cheng, 3F., No. 31, Lane 216, Gongyuan Rd., HsinChu City (TW) 30069

(73) Assignees: Yi-Tsan Cheng, Hsinchu (TW); Jui-Chuan Wu, Benchiao, Taipei (TW)

( * ) Notice: Subject to any disclaimer, the term of this patent is extended or adjusted under 35 U.S.C. 154(b) by 0 days.

(21) Appl. No.: 12/108,526

(22) Filed: Apr. 24, 2008

(51) Int. Cl.
*H01Q 13/10* (2006.01)

(52) U.S. Cl. ..... 343/767; 343/770

(58) Field of Classification Search ..... 343/767, 343/770
See application file for complete search history.

(56) References Cited

U.S. PATENT DOCUMENTS 2,507,528 A * 5/1950 Kandoian ..... 343/767
2,996,715 A * 8/1961 Rumsey et al. ..... 343/767
5,489,913 A * 2/1996 Raguenet et al. ..... 343/767
6,373,442 B1 * 4/2002 Thomas et al. ..... 343/767
6,703,983 B2 * 3/2004 Huang ..... 343/768
2002/0171594 A1 * 11/2002 Fang ..... 343/767
2004/0066345 A1 * 4/2004 Schadler ..... 343/767

* cited by examiner

*Primary Examiner*—Tho G Phan
(74) *Attorney, Agent, or Firm*—Leong C. Lei

(57) ABSTRACT

The open-slot antenna contains a rectangular main metallic plate having a similarly shaped slot, first and second auxiliary metallic plates extended perpendicularly from the main metallic plate for about the same distance, and a coaxial cable connecting to the main metallic plate across the slot. The first auxiliary metallic plate is positioned generally along a middle range of a longer section of the main metallic plate while the second auxiliary metallic plate is positioned to a side of the first auxiliary metallic plate with an appropriate spacing therebetween. The length of the first auxiliary metallic plate is larger than that of the second auxiliary metallic plate.

5 Claims, 5 Drawing Sheets

OPEN-SLOT ANTENNA

TECHNICAL FIELD OF THE INVENTION

The present invention generally relates to antenna, and more particularly to an open-slot antenna involving a less number of design factors for greater design efficiency.

DESCRIPTION OF THE PRIOR ART

As shown in FIG. 1, a conventional open-slot antenna commonly utilized in cellular phones, network devices, and personal digital assistants mainly contains a flat, narrow, rectangular metallic plate 10 with a similarly shaped rectangular slot 11. The metallic plate 10 therefore could be considered as having two longer sections and two shorter sections surrounding the slot 11. The conventional open-slot antenna also contains a coaxial cable 20 having a core conductor 22 wrapped inside an insulation layer 21 which is in turn wrapped inside a metallic braid 23. The coaxial cable 20 has its core conductor 22 welded to a first longer section 12 of the metallic plate 10, and has its metallic braid 23 welded to a second longer section 13 of the metallic plate 10.

For people skilled in the related art, it is well known that, when an antenna is originally designed, it is difficult, if not impossible, to take into detailed considerations of the factors derived from the actual environment where the antenna is to be installed and used. Engineers therefore have to modify the antenna's original design later when these factors have become certain before putting the antenna into mass production. The modification is a labor intensive and time consuming process. For open-slot antennas, as shown in FIG. 2, the widths W1 and W2 of the shorter sections of the metallic plate 10 affect a high frequency and a low frequency of the antenna. On the other hand, the widths W3, W4, W5, and W6 affect the bandwidths of the high and low frequencies of the antenna. These six factors are interrelated and an engineer has to modify the antenna and try various combinations. It is common that it would take an engineer two or three days to complete an acceptable modification, significantly reducing the product design efficiency.

SUMMARY OF THE INVENTION

The primary purpose of the present invention is to provide a novel open-slot antenna which has a less number of design factors to be considered in modifying the antenna so as to increase the design efficiency of the open-slot antenna.

The open-slot antenna contains a rectangular main metallic plate having a similarly shaped slot, first and second auxiliary metallic plates extended perpendicularly from the main metallic plate for about the same distance, and a coaxial cable connecting to the main metallic plate across the slot. The first auxiliary metallic plate is positioned generally along a middle range of a longer section of the main metallic plate while the second auxiliary metallic plate is positioned to a side of the first auxiliary metallic plate with an appropriate spacing therebetween. The length of the first auxiliary metallic plate is larger than that of the second auxiliary metallic plate. The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 3:
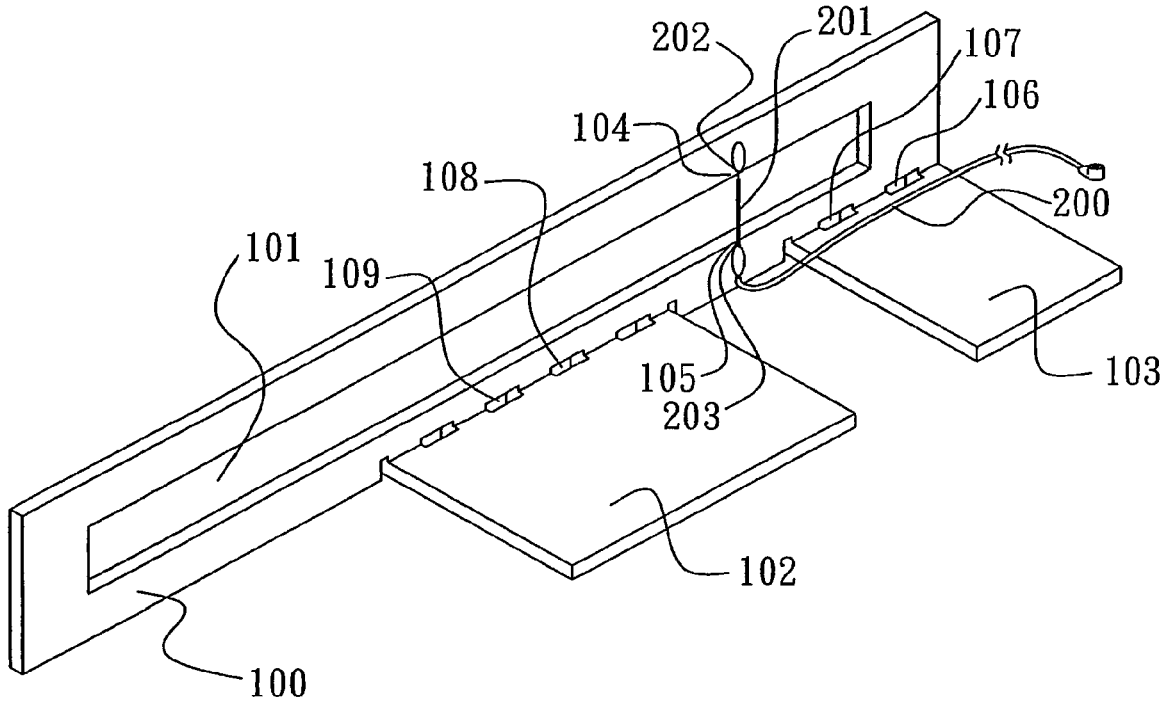
FIG. 3 is a perspective diagram showing an open-slot antenna according to a first embodiment of the present invention.

As shown in FIG. 3, an open-slot antenna according to a first embodiment of the present invention, similar to the conventional open-slot antennas, contains a flat, narrow, rectangular main metallic plate 100 and a coaxial cable 200. The main metallic plate 100 has a similarly shaped rectangular slot 101 generally in the center of the metallic plate 100. The main metallic plate 100 therefore has two longer sections and two shorter sections surrounding the slot 101 circumferentially.

The open-slot antenna also contains a first auxiliary metallic plate 102 and a second auxiliary metallic plate 103 extended perpendicularly from a second longer section 105 of the main metallic plate 100. The first auxiliary metallic plate 102, for the reception and transmission of low-frequency radio waves, is positioned generally along a middle range of the second longer section 105 while the second auxiliary metallic plate 103, for the reception and transmission of high-frequency radio waves, is positioned to a side of the first auxiliary metallic plate 102 with an appropriate spacing therebetween. The widths W9 and W10 (see FIG. 4) of the first and second auxiliary metallic plates 102 and 103 are about the same while the length (along the second longer section 105) of the first auxiliary metallic plate 102 is larger than that of the second auxiliary metallic plate 103.

The coaxial cable 200 has a core conductor 202 wrapped inside an insulation layer 201 which is in turn wrapped inside a metallic braid 203. The coaxial cable 200 has its core conductor 202 welded to a spot along a first longer section 104, and has its metallic braid 203 welded to a spot along the second longer section 105 of the metallic plate 10, both between the first and second auxiliary metallic plates 102 and 103.

Please note that the first and second auxiliary metallic plates 102 and 103 could be integral parts of the main metallic plate 100 and there are perforations 106, 107, 108, and 109 between the main metallic plate 100 and the first and second auxiliary metallic plates 102 and 103 so that the first and second auxiliary metallic plates 102 and 103 could be easily bended to become perpendicular to the main metallic plate 100.

Figure 1:
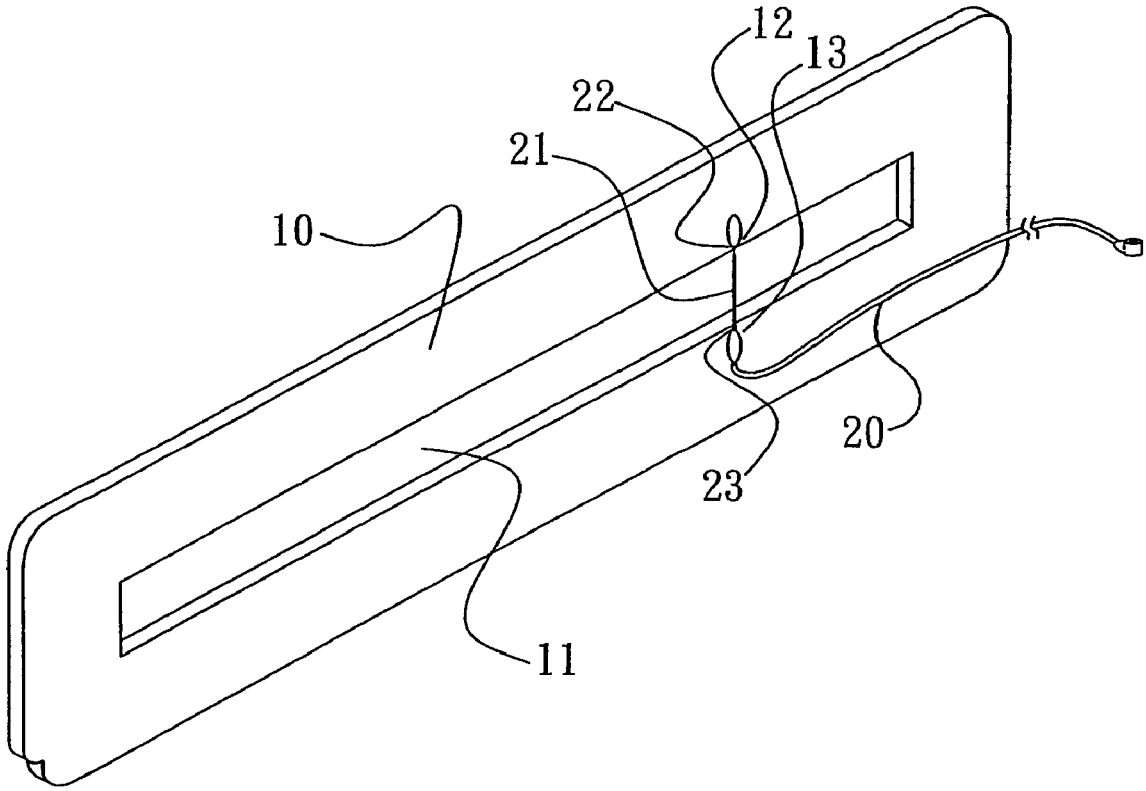
FIG. 1 PRIOR ART
FIG. 1 is a perspective diagram showing a conventional open-slot antenna.
Figure 2:
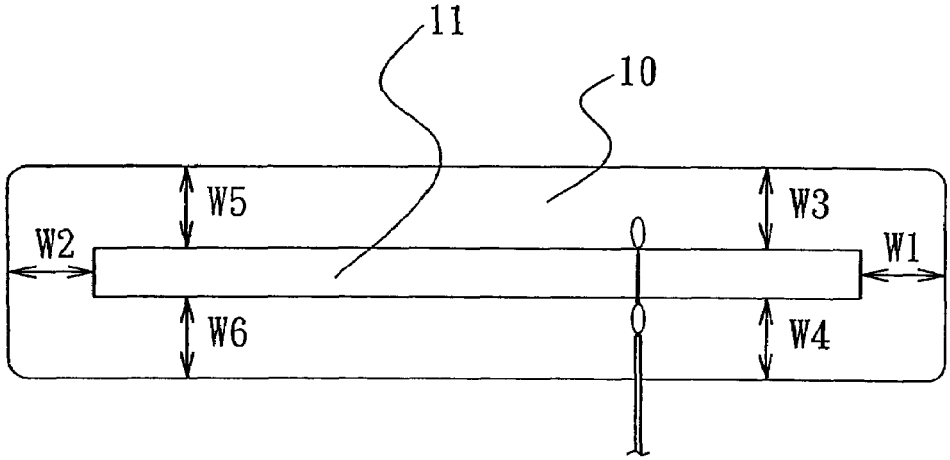
FIG. 2 PRIOR ART
FIG. 2 is a schematic diagram showing the various factors to be considered in designing the conventional open-slot antenna of FIG. 1.
Figure 4:
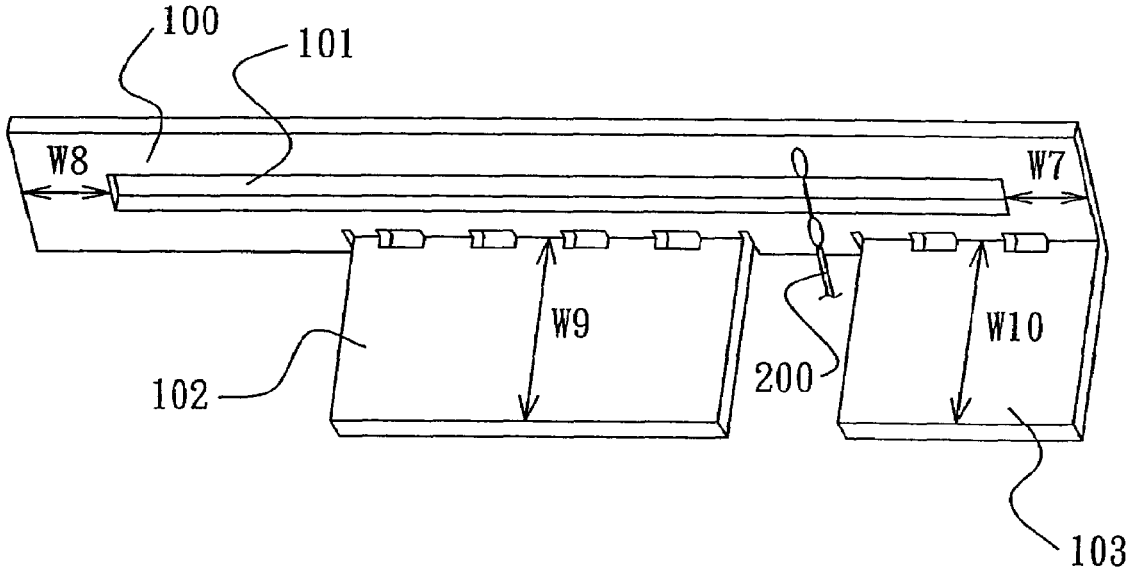
FIG. 4 is a schematic diagram showing the various factors to be considered in designing the open-slot antenna of FIG. 3.

As illustrated in FIG. 4, the width W7 of a first shorter section of the metallic plate 10 that is adjacent to the second auxiliary metallic plate 103 affects a high frequency of the antenna. The width W8 of a second shorter section of the metallic plate 10 that is distant from the second auxiliary metallic plate 103 affects a low frequency of the antenna. On the other hand, the widths W9 and W10 of the first and second auxiliary metallic plates 102 and 103 affect the bandwidths of the high and low frequencies of the antenna. As such, the number of factors to be considered has reduced from the conventional antenna's six to four.

Figure 5:
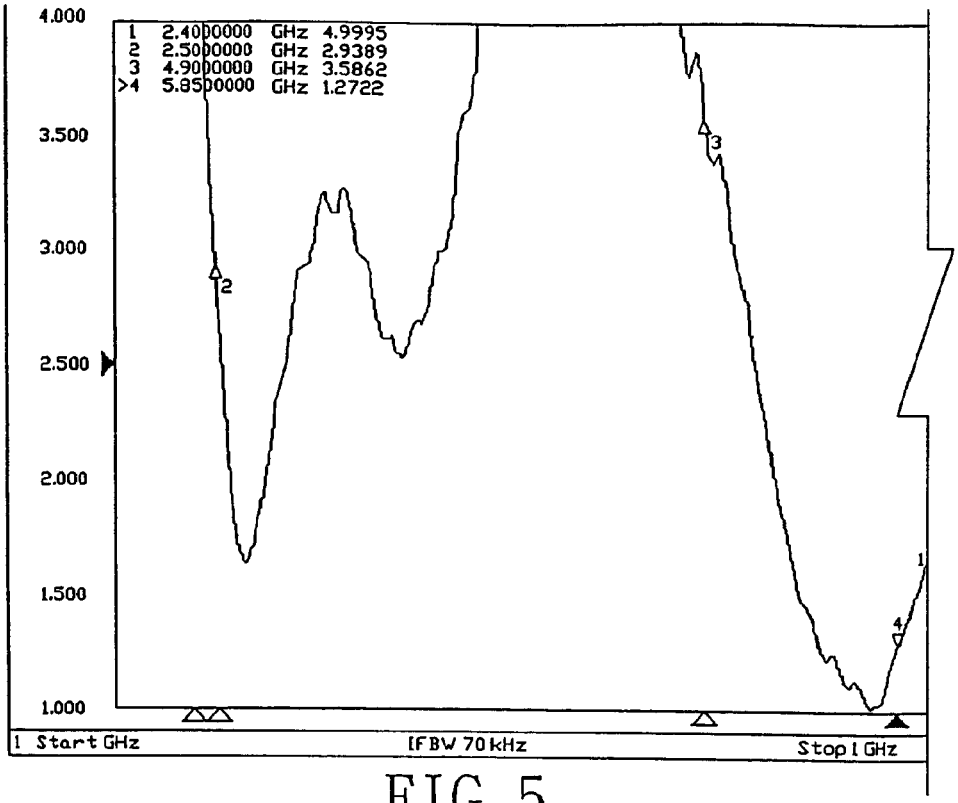
FIG. 5 is a graph showing a VSWR curve of an open-slot antenna of the present invention before modification.
Figure 6:
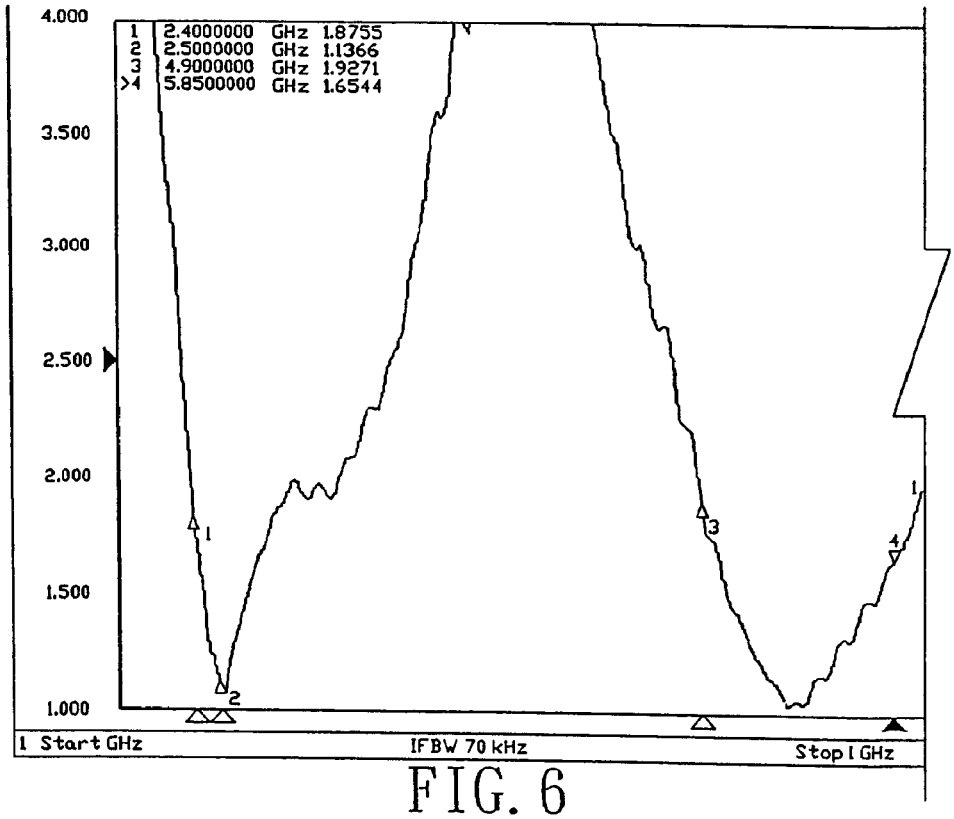
FIG. 6 is a graph showing a VSWR curve of an open-slot antenna of the present invention after modification.

One of the major performances of an open-slot antenna is the voltage standing wave ratio (VSWR or SWR). FIG. 5 is a graph showing a VSWR curve of an open-slot antenna according to the present invention before modification. Due to the reduced number of factors, an engineer, after only a half day's work, could modify the open-slot antenna into having a better VSWR curve shown in FIG. 6, saving 75%~83% of time.

Figure 7:
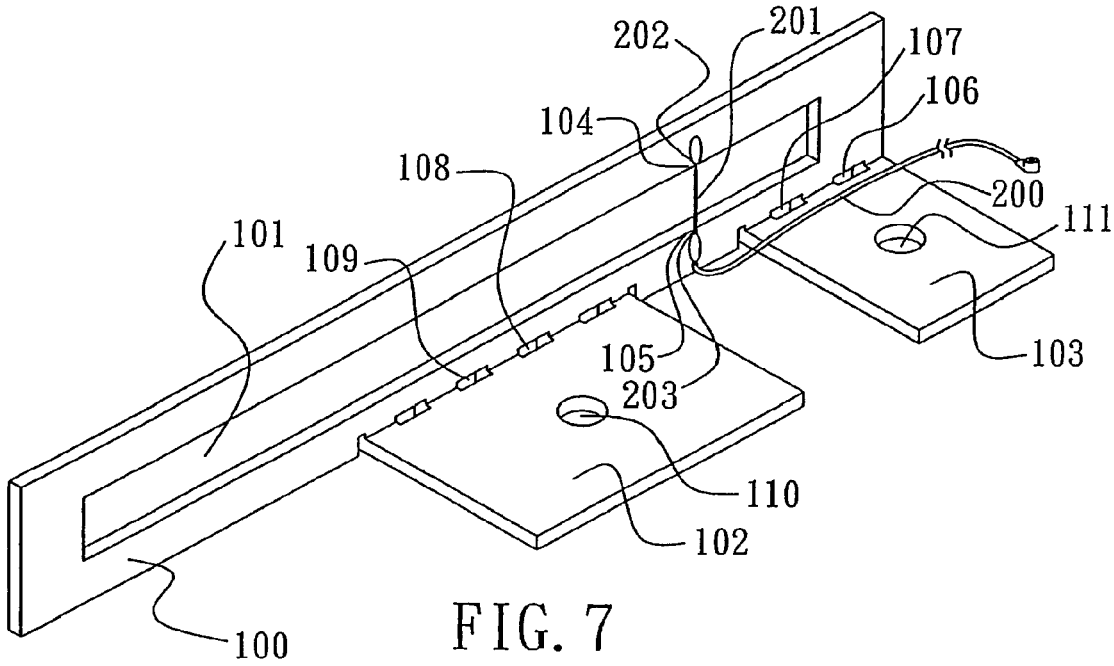
FIG. 7 a perspective diagram showing an open-slot antenna according to a second embodiment of the present invention.
Figure 8:
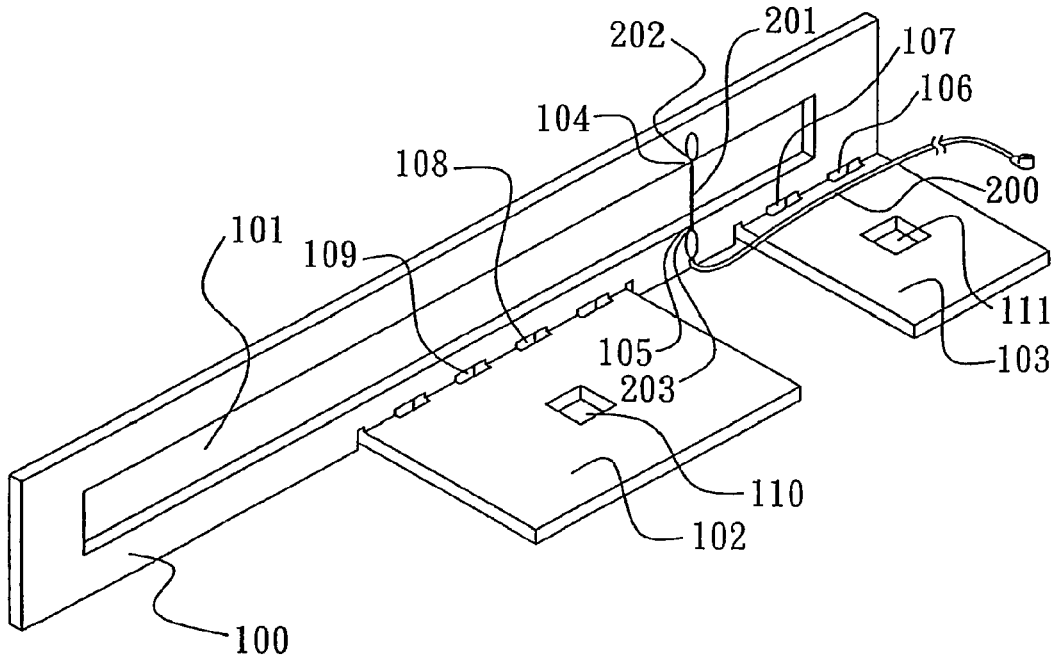
FIG. 8 a perspective diagram showing an open-slot antenna according to a third embodiment of the present invention.

As shown in FIG. 7, a second embodiment of the present invention could have through openings 110 and 111 on the first and second auxiliary metallic plates 102 and 103, respectively. These through openings 110 and 111 could be used to install or position the antenna by applying screws or other means. As further shown in FIG. 8, the through openings 110 and 110 could have rectangular cross-sections, other than the circular ones shown in FIG. 7.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An open-slot antenna, comprising:

a narrow and rectangular main metallic plate having a similarly shaped rectangular slot, said main metallic plate having two longer sections and two shorter sections surrounding said slot circumferentially;

a first auxiliary metallic plate extended for a distance perpendicularly from a middle range of a second longer section of said metallic plate;

a second auxiliary metallic plate extended for roughly said distance perpendicularly from said second longer section of said metallic plate to a side to said first auxiliary metallic plate with a spacing therebetween; and a coaxial cable having a core conductor wrapped inside an insulation layer which is in turn wrapped inside a metallic braid; wherein said first auxiliary metallic plate has a length along said second longer section longer than that of said second auxiliary metallic plate; said core conductor of said coaxial cable is welded to a spot along a first longer section of said main metallic plate between said first and second auxiliary metallic plates; and said metallic braid is welded to a spot along said second longer section of said main metallic plate between said first and second auxiliary metallic plates.

2. The open-slot antenna according to claim 1, wherein there are a plurality of perforations between said main metallic plate and said first and second auxiliary metallic plates.

3. The open-slot antenna according to claim 1, wherein said first and second auxiliary metallic plates have at least a through opening.

4. The open-slot antenna according to claim 3, wherein said through opening has a circular cross-section.

5. The open-slot antenna according to claim 3, wherein said through opening has a rectangular cross-section.

* * * * *